United States Patent [19]

Nishimura

[11] Patent Number: 4,741,403

[45] Date of Patent: May 3, 1988

[54] AUTOMATIC FIRE EXTINGUISHING SYSTEM

[75] Inventor: Yoshitaka Nishimura, Hikone, Japan

[73] Assignee: Iron Work Nishimura Co., Ltd., Hikone, Japan

[21] Appl. No.: 894,905

[22] Filed: Aug. 8, 1986

[30] Foreign Application Priority Data

Mar. 11, 1986 [JP] Japan ..... 61-36370

[51] Int. Cl.[4] ..... A62C 35/52; A62C 37/18

[52] U.S. Cl. ..... 169/61; 169/26

[58] Field of Search ..... 169/60, 26, 13, 9, 11, 169/19, 5, 23, 61

[56] References Cited

U.S. PATENT DOCUMENTS

| | | | |
|---|---|---|---|
| 3,016,956 | 5/1959 | Olandt | 169/11 |
| 3,990,518 | 11/1976 | Hemme | 169/60 |
| 4,027,302 | 5/1977 | Healey et al. | 169/61 |
| 4,183,409 | 1/1980 | Iida | 169/26 X |
| 4,183,721 | 1/1980 | Peterson | 169/13 |
| 4,356,868 | 11/1982 | Bentley et al. | 169/26 |

FOREIGN PATENT DOCUMENTS

| | | | |
|---|---|---|---|
| 2298344 | 8/1976 | France | 169/13 |
| 814359 | 3/1981 | U.S.S.R. | 169/9 |

*Primary Examiner*—Joseph F. Peters, Jr.
*Assistant Examiner*—James M. Kannofsky
*Attorney, Agent, or Firm*—Wenderoth, Lind & Ponack

[57] ABSTRACT

An improved fire extinguishing system is proposed which uses both water and a fire extinguisher chemical. When a fire alarm senses an abnormally high temperature, a fire extinguisher will be sprinkled first. Only if this fails to extinguish the fire, water will be sprinkled from the water nozzle. This prevents damage of over-discharge of water. There is no fear of water spreading a fire caused by a flammable liquid.

4 Claims, 2 Drawing Sheets

AUTOMATIC FIRE EXTINGUISHING SYSTEM

FIELD OF THE INVENTION

The present invention relates to an automatic fire extinguishing system designed to use both water and a chemical fire extinguisher.

DESCRIPTION OF THE PRIOR ART

A conventional fire extinguishing system includes sprinkler heads, each of which is kept under water pressure from an elevated tank or a pressure tank and is adapted to open with the action of heat by fire. When water starts to be sprinkled from the sprinkler head, the water flow through a pipe between the sprinkler head and the elevated water tank actuates an automatic alarm valve provided in the pipe line to give an alarm electrically or mechanically. Simultaneously an electric control panel gives a signal to start a sprinkler pump. In other systems, a pressure drop in the pressure water tank actuates a pressure switch to start a pressurized water feed unit.

With such conventional systems, there was the risk of water sprinkled from a sprinkler head spreading the fire in cases of fire caused by a flammable liquid. Another problem is that water sprinkling cannot subdue flames instantly as a chemical fire extinguisher can.

SUMMARY

An object of the present invention is to provide an automatic fire extinguishing system which obviates the abovesaid shortcomings.

In accordance with the present invention, there is provided an automatic fire extinguishing system comprising a fire alarm, a water nozzle, a chemical fire extinguisher nozzle, the water nozzle and fire extinguisher nozzle being provided near the fire alarm, a source of water connected to the water nozzle, a chemical fire extinguisher tank connected to the chemical fire extinguisher nozzle, a first valve means connected between the water nozzle and the source of water, a second valve means connected between the fire extinguisher nozzle and the fire extinguisher tank, and control means receiving the signal from the fire alarm for controlling the first and second valve means, so that the second valve means will be opened in response to the signal from the fire alarm and the first valve means will be opened if the signal from the fire alarm remains on for a longer time than a predetermined period of time.

When the fire alarm senses the breaking out of the fire, the solenoid valve for the fire extinguisher feed line opens so that the fire extinguisher will be sprinkled from the fire extinguisher nozzles to extinguish the fire. The sprinkling of the fire extinguisher continues until the tank becomes empty. If it fails to extinguish the fire, the solenoid valve for the water feed line will open to sprinkle water from the water nozzles.

With the automatic extinguishing system embodying the present invention, a chemical fire extinguisher is used for initial fire extinguishment and, if the fire does not extinguish even by a fire extinguisher, water is sprinkled. Thus, there is no fear of water spreading fire caused by a flammable liquid. As a fire extinguisher is used at an initial stage, the flame can be put out instantly. Also, if the fire has been extinguished successfully by use of a chemical fire extinguisher only, water is not sprinkled. Thus, property damage owing to overdischarge of water can be avoided.

Other objects and features of the present invention will become apparent from the following description taken with reference to the accompanying drawings, in which:

DESCRIPTION OF THE PREFERRED EMBODIMENT

Figure 1:
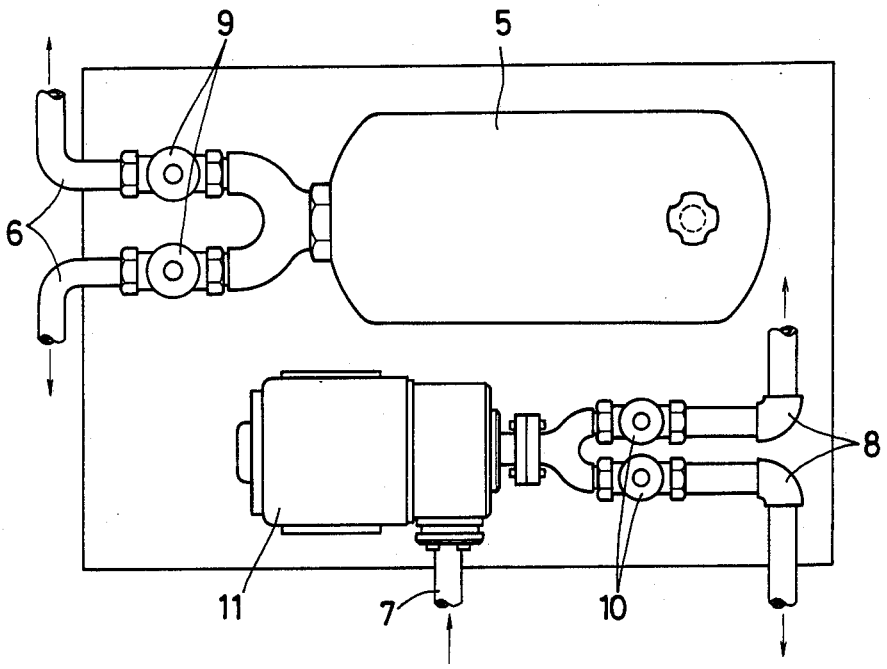
FIG. 1 is a plan view of the fire extinguishing system embodying the present invention.
Figure 2:
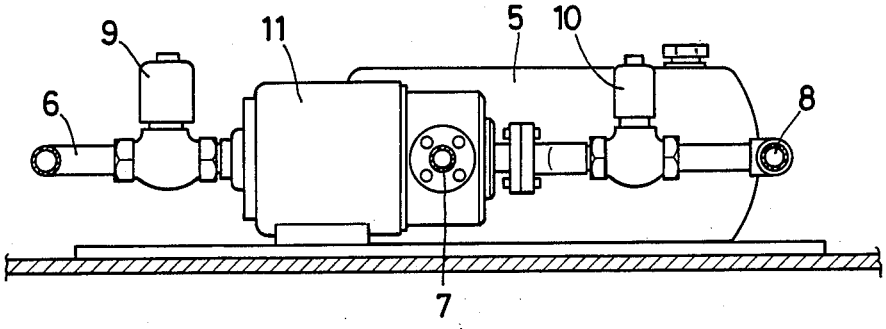
FIG. 2 is a front view thereof.
Figure 3:
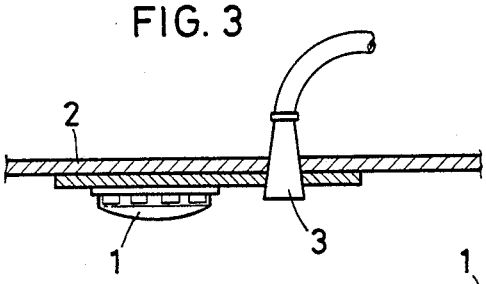
FIG. 3 is a front view showing how the nozzle and the fire alarm are mounted.
Figure 4:
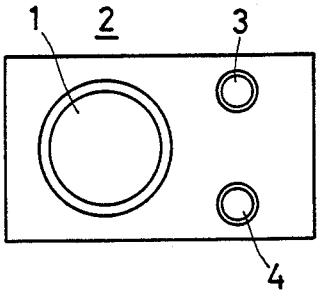
FIG. 4 is a bottom view showing the same.

Referring to the drawings, a fire alarm 1 is mounted on a ceiling 2. A water nozzle 3 and a fire extinguisher nozzle 4 are provided near the fire alarm 1 (FIG. 4). The fire extinguisher nozzle 4 is connected to a fire extinguisher tank 5 through a pipe 6. Each of the water nozzles 3 is connected to a water feed pipe 7 through a pipe 8. The flows through the pipes 6 and 8 are controlled by solenoid valves 9, 10, respectively.

In operation, when the fire alarm 1 senses the breaking out of fire, it will open the solenoid valve 9, so that the fire extinguisher tank 5 will be fed through the pipe 6 and be spouted from the nozzle 4. The spouting from the nozzle 4 will continue until the tank 5 becomes vacant.

However, if the fire extinguisher fails to extinguish the fire, so that the temperature will remain above a preset temperature for a longer time than a preset period of time, the fire alarm 1 will open the solenoid valve 10 to spout water from the water nozzle 3 through the pipe 8. When the fire alarm 1 senses the temperature drop to a normal temperature, it will close the solenoid valve 10 to stop the water discharge. Conveniently, a pump 11 may be provided in the water feed line and it may be adapted to start at the same time when the solenoid valve 10 opens.

Figure 5:
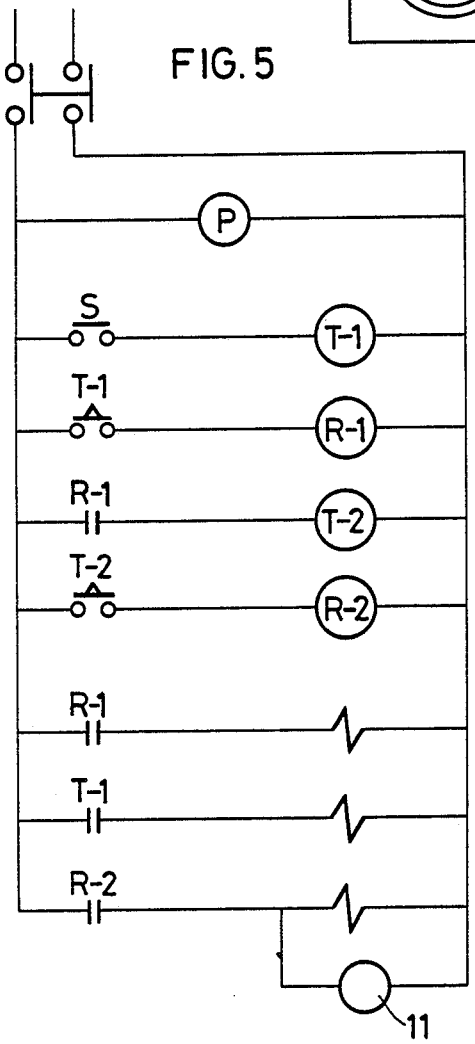
FIG. 5 is a circuit diagram of a control circuit for controlling solenoid valves.

In order to control the automatic fire extinguishing system, such a control circuit as shown in FIG. 5 may be used. We shall described briefly how it operates.

If the ambient temperature for a sensing element S of the fire alarm 1 rises above a preset temperature (68–70° C.) and remains at such a high level for a longer time than a preset period of time (above 30–40 seconds), a timer T-1 will turn on and a siren or buzzer will go. Simultaneously a relay R-1 will be energized and the solenoid valve 9 will be opened, so that the fire extinguisher will be discharged until the fire extinguisher tank 5 becomes empty (about 30 seconds). If the relay R-1 remains energized even after the tank 5 has become empty (namely the ambient temperature remains high), a timer T-2 will turn on and a relay R-2 will be energized, so that the solenoid valve 10 will open and the pump 11 will start to spout water from the water nozzle 3.

If the ambient temperature drops below the preset temperature as a result of water discharge, the timer T-1 will turn off and the relay R-1 deenergizes. Simultaneously the timer T-2 will turn off and the relay R-2 deenergizes. As a result, the solenoid valve 10 will be closed, so that damage by overdischarge of water will be prevented. If the fire alarm 1 senses a high temperature continually, water discharge will continue until the temperature drops below the preset temperature. If the temperature rises again above the preset temperature after it has dropped below, the abovesaid steps will be repeated to restart water discharge. A fire extinguisher tank may be installed on the ceiling or roof and be connected through a pipe to the fire extinguisher nozzle in each of the rooms.

What I claim:

1. An automatic fire extinguishing system comprising a fire alarm, a signal means for generating a signal being connected to said alarm, a water nozzle, a fire extinguisher nozzle means, said water nozzle and fire extinguisher nozzle means being connected to said fire alarm, a first valve means for connecting said water nozzle and a source of water, a second valve means for connecting said fire extinguisher nozzle means and a fire extinguisher tank, and control means for receiving the signal from said fire alarm and for controlling said first and second valve means, for causing said second valve means to be opened in response to the signal from said fire alarm, and for causing said first valve means to be opened when the signal from said fire alarm is generated for longer than a predetermined period of time.

2. The system of claim 1, wherein said fire extinguisher nozzle means comprises a chemical extinguishant distributing fire extinguisher nozzle.

3. The system of claim 1, further comprising a fire extinguisher tank connected to said second valve means.

4. The system of claim 2, further comprising a fire extinguisher tank connected to said second valve means.

* * * * *